US005961688A

United States Patent [19]

Meierling et al.

[11] Patent Number: 5,961,688

[45] Date of Patent: Oct. 5, 1999

[54] PROCESS AND DEVICE FOR MAKING LIQUID IRON BY NON-ELECTRIC AND ELECTRIC SMELTING

[75] Inventors: Peter Meierling, Düsseldorf; Udo Falkenreck, Bochum; Stefan Lemke, Witten; Udo Evers, Bottrop, all of Germany

[73] Assignee: Mannesmann Aktiengesellschaft, Düsseldorf, Germany

[21] Appl. No.: 08/793,777

[22] PCT Filed: Sep. 15, 1995

[86] PCT No.: PCT/DE95/01311

§ 371 Date: Apr. 7, 1997

§ 102(e) Date: Apr. 7, 1997

[87] PCT Pub. No.: WO96/08584

PCT Pub. Date: Mar. 21, 1996

[30] Foreign Application Priority Data

Sep. 15, 1994 [DE] Germany ..... 44 34 369

[51] Int. Cl.[6] ..... C21B 11/10

[52] U.S. Cl. ..... 75/10.38; 266/159

[58] Field of Search ..... 75/10.38; 266/159

[56] References Cited

U.S. PATENT DOCUMENTS

| | | | |
|---|---|---|---|
| 5,393,037 | 2/1995 | Ehle et al. | 266/159 |
| 5,541,952 | 7/1996 | Genge et al. | 75/10.38 |
| 5,611,838 | 3/1997 | Fritz et al. | 75/10.38 |

*Primary Examiner*—Melvyn Andrews
*Attorney, Agent, or Firm*—Cohen, Pontani, Lieberman & Pavane

[57] ABSTRACT

A process and a steelmaking device for the metallurgical treatment of iron metals, especially for producing steel melts. To carry out metallurgical processing of iron metals, and especially to produce steel melts, in an energy-saving, environmentally friendly and economical fashion, all metallurgical processes are carried out in a single vessel. This vessel first functions as a converter and then, without the melt product being poured out, functions subsequently as an electric arc furnace.

21 Claims, 2 Drawing Sheets

PROCESS AND DEVICE FOR MAKING LIQUID IRON BY NON-ELECTRIC AND ELECTRIC SMELTING

BACKGROUND OF THE INVENTION

1. Field of the Invention

The invention relates to a process for the metallurgical treatment of iron metals, especially for producing molten steel. The invention further relates to an associated steel-making device with at least one metallurgical vessel that can be closed by a swivelling cover, which is connected via a flue gas elbow to a gas purification unit and through the center of which at least one electrode can be run, with a device for filling the vessel with charge material, and with a flush-off opening and a tap opening for hot metal located in the bottom of the vessel.

2. Description of the Prior Art

The marketplace demands better and better quality from the operators of electric steelmaking plants in respect to the level, continuity and price of steel products. In light of fluctuating costs for raw materials, more and more producers are planning to use, in addition to scrap, larger quantities of pig iron (molten or in ingots) in electric steel mills.

Until now, the blowing of pig iron with high oxygen rates was only carried out in converters. For example, a device is known from DE OS 28 03 960 for refining pig iron with oxygen or oxygen-enriched gases, wherein a main hood is provided to collect waste gases that escape during the refining process. The waste gases are suctioned away through an extraction pipe, which is connected to the main hood and leads to a dust removal unit. The extraction pipe has an opening through which an oxygen lance can usually be directed.

The main extraction hood is connected to a cover, which is arranged independently of the metal vessel, and forms with it a unit that can be moved to the side.

Electric arc furnaces are usually operated with direct or alternating current. For example, DE 43 02 285 A1 discloses a double furnace with two furnace vessels (as well as a process to operate this device) that can be covered by covers, which are connected via flue gas elbows to a gas purification unit. FIG. 2 of the aforementioned document shows three electrodes through the cover of a furnace operated with three-phase current and one electrode through the cover and a counterelectrode in the bottom of the vessel of a direct-current furnace. The two furnaces are operated in such a manner that the first furnace is supplied with electric power to melt the charge located in it, while the other furnace remains completely separate from the electric network and is supplied, after charging, with hot flue gases from the first furnace. The metallurgical process used is a one-stage process.

Metallurgical vessels have also been proposed already. For example, DE 34 19 030 C1 discloses a metallurgical reaction vessel, especially a steel works converter, which, for each step of a process and for the operational devices arranged above and/or under the reaction vessel, the corresponding functional component, is installed accessibly in rotary fashion around a vertical rotational axis. The operational devices include an offtake pipe, a charging device, a test lance, a blowing lance and a bottom descent device, for example. These devices are installed in a fixed fashion, while the reaction vessel is rotated into the appropriate position via the vertical rotational axis.

The reaction vessel is suitable, in each instance, for a single process. For example, it is used to produce metal melts, especially steel melts, and to produce gases, e.g., CO gases from coal and a reaction-enhancing substance, which assists the reaction by its presence and is consumed only slightly or not at all, e.g., pig iron melts.

SUMMARY OF THE INVENTION

The object of the invention is to create a process and a suitable device for metallurgically processing iron metals, especially for producing steel melts, in an energy-saving, environmentally friendly and economical fashion.

Pursuant to this object, and others which will become apparent hereafter, one aspect of the present invention resides in a process for metallurgically treating iron metals in a vessel, the process including the steps of: furnishing Al/Si for deoxidizing a metal pool on a bottom of the vessel; charging low carbon iron charge materials into the vessel; furnishing non-electric heat energy by supplying oxygen to the vessel; implementing refining while simultaneously charging pig iron and adding lime; removing up to 50% of slag that contains $Si/O_2$; suctioning off waste gases during a top blowing phase; removing slag that contains phosphorus at an end of refining; furnishing heat energy via an electric arc; suctioning off flue gases; removing residual slag; and tapping liquid melt while loading a pool.

In another embodiment of the invention scrap is used as the charge material. In a further embodiment the refining is carried out by top blowing oxygen. It is also possible to carry out the refining by burning an oxygen-natural gas mixture or an oxygen-oil mixture with an over-long flame in a hyper-stoichiometeric manner.

In still another embodiment of the invention the charge materials are charged in liquid form at a temperature over 1300° C.

An additional embodiment of the invention provides that the liquid pig iron and liquid charge material are charged at a ratio of liquid pig iron to liquid iron charge material of approximately 50:50.

In still another embodiment pig iron and scrap charge material are charged at a ratio of scrap:pig iron in a range of 20:80 to 40:60.

Still another embodiment provides that scrap charge material, liquid iron charge material and pig iron are charged at a ratio of scrap:pig iron:liquid iron charge material in a range of 10:60:30 to 10:40:50.

Another aspect of the present invention resides in a steel making device comprising at least one metallurgical vessel which can be closed by a swingable cover and is connected via a flue gas elbow to a gas purification unit. At least one electrode runs through the cover center. Furthermore, a device is provided for filling the vessel with charge material. A flush-off opening a melt tap opening are provided in a bottom of the vessel. The cover center is configured to be removable from the cover, so that an opening of a waste gas elbow can be placed on the cover center opening. At least one lance can be brought into the interior of the metallurgical vessel through the cover center opening via the waste gas elbow.

According to the invention, all metallurgical processing work is carried out in a single vessel. The vessel first performs the function of a converter. Directly after this, without the molten product being poured out, the vessel performs the function of an electric arc furnace. Especially advantageously, this process can be implemented in two metallurgical vessels, the work cycles of which overlap by 50%.

After the slag-free tapping of the metal melt from the electric arc furnace, a pool exists in the bottom of the vessel, which was needed in standard electric arc melts to start the process over again. In the present process, Al/Si is added to bind the liquid metal pool in order to prevent violent reactions with the molten metal. A charge of low-carbon metal in the form of scrap or liquid metal is then added.

After this, oxygen is top-blown to reduce the silicon content, and the charge as a whole is heated. During the reduction process, pig iron is added as cooling material, in order to keep the steel temperature at a preestablished value. At the same time, calcium is added to adjust the basicity. Throughout this entire time, no electric processing of any kind is required. Meanwhile, approximately 50% of the silicon-enriched slag is removed. During the reduction process, the waste gases are suctioned away. After the top blowing ends, the phosphorous-containing slag is removed.

At this point, an exchange of operational devices is undertaken. Specifically, the lance and the waste gas elbow are removed and, instead, electrodes are put into place and the flue gas line is opened, so that melting can be carried out by the electric arc furnace. At the end of the process, the residual slag is removed and the liquid melt is tapped through the bottom tap.

It is proposed that, instead of blowing oxygen with an oxygen lance, oxygen-natural gas burners or oxygen-oil burners be used to decarbonize the pig iron and these burners be operated with an overlong flame and in a hyperstoichiometric mode.

When liquid metal is charged, it has a temperature of over 1300° C. Various metal mixtures are proposed. A ratio of liquid pig iron to liquid metal of roughly 50:50 has proven economical. Furthermore, a ratio of scrap to pig iron of approximately 30:70 is proposed. It is also suggested that the ratio of scrap:pig iron:liquid metal be in the range of 10:60:30 to 10:40:50.

After each completed process step, the bottom tap is cleaned and reclosed. Furthermore, the appropriate charge material is added, the cover of the furnace vessel is closed, and the lance or burners and the waste gas elbow are moved into position. The process can then be started anew.

When a two-furnace unit is used, a melting process with electrodes is carried out in the second furnace vessel during blowing. The flue gases from this melting process are fed through a waste gas elbow to a mixing chamber, where they mix with the waste gases from the blowing process. Because the blowing process allows very high waste gas temperatures by virtue of CO afterburning, any colder waste gases from the electric furnace operation will be reliably combusted. As a result, potentially offensive odors and even other hydrocarbon compounds, such as furane and dioxine, are reliably avoided.

To implement the process, the invention proposes a steelmaking device with a metallurgical vessel, in which a cover is used, the centers of which are removable. The opening of a waste gas elbow is placed on the cover-center opening. At least one lance or one burner enters the interior of the upper part of the metallurgical vessel through this elbow and the opening in the cover.

Because of these adapted parts, it is possible, with little manual labor and extremely simple means, to transform the metallurgical vessel from an electric arc furnace into a converter. The lance running through the waste gas elbow is connected to a movement device, which allows the lance head to be submerged into the vessel to a predetermined depth.

The lance can be designed as a pure oxygen lance or a pure burner. It can also be designed as a multifunctional lance.

The standard waste gas elbow for the electric arc furnace has blocking elements, which are closed during the blowing phase and during extraction through the waste gas elbow.

It is proposed that for the purpose of charging with liquid metal or liquid pig iron, a bulge be provided on the lower part of the vessel to ensure that the liquid charge can be supplied simply.

When a steelmaking device with two metallurgical vessels is used, only one lance or one burner device and only one waste gas elbow is used. Moreover, only one electrical feed by means of a bracket and electrode or electrodes is required.

Because the electrode bracket and the waste gas elbow, including the lances or burner device, are arranged so as not to collide, the respective functions of the vessels can be changed by a simple, brief swivelling. The disadvantageous opening of covers is done away with, as is the necessity of pouring out the melts located in the vessels.

Even in an E-furnace unit with one only furnace vessel, the centers of gravity of the electrode swivelling device and the rotary device of the waste gas elbow are arranged on a separation line, which precisely separates the first furnace vessel from the second (expansion) furnace vessel.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
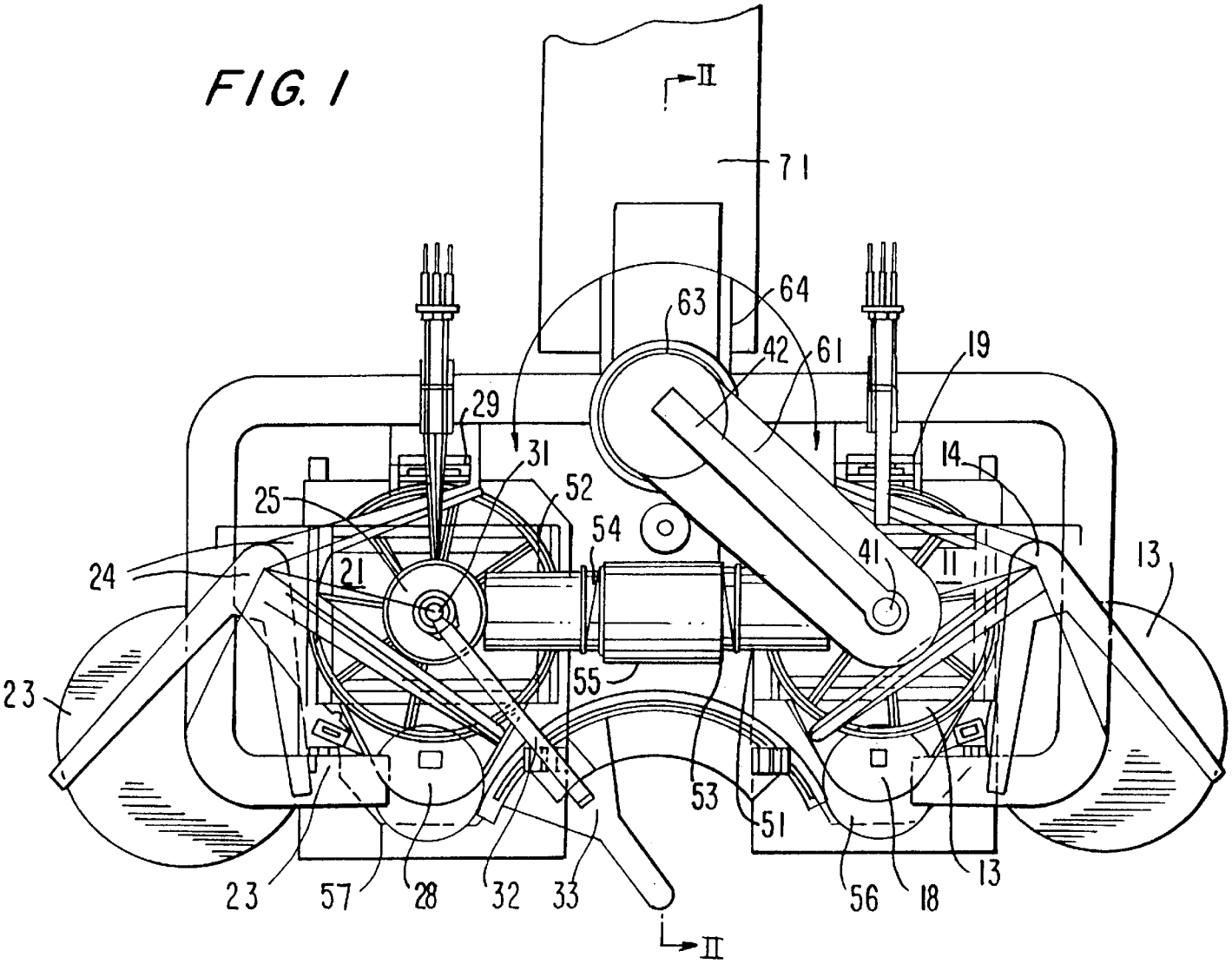
FIG. 1 is a top view of the inventive device.

FIG. 1 shows a top view of a single-furnace unit, which can be expanded into a double-furnace unit. The top view (from the furnace vessel) shows the bulge 18 (28) and the tap hole 19 (29) (a slag door here) of the cover 13 (23), which is suspended on the cover swivelling device 14 (24). The swivelled-out and operational positions can be seen.

In the optional second furnace, the cover center 25 can be clearly seen.

Attached to the cover 13 (23) are flue gas elbows 51, 52, which are connected via a blocking valve 53 (54) to a main flue gas line 55. In addition, the suctioning devices 56 (57) of the bulge 18 (28) are attached to the main flue gas line 55.

The cover 13 is detachably connected to a waste gas elbow 61, which can be swivelled by a turning device 63. The main flue gas line 55 and a main waste gas line 64 are run together in an afterburning chamber 71. A lance 41, which is held by a lance bracket 42, runs through the waste gas elbow 61.

An electrode 31, which is attached via an electrode bracket 32 to an electrode pivoting device 33, runs through the cover center 25.

Figure 2:
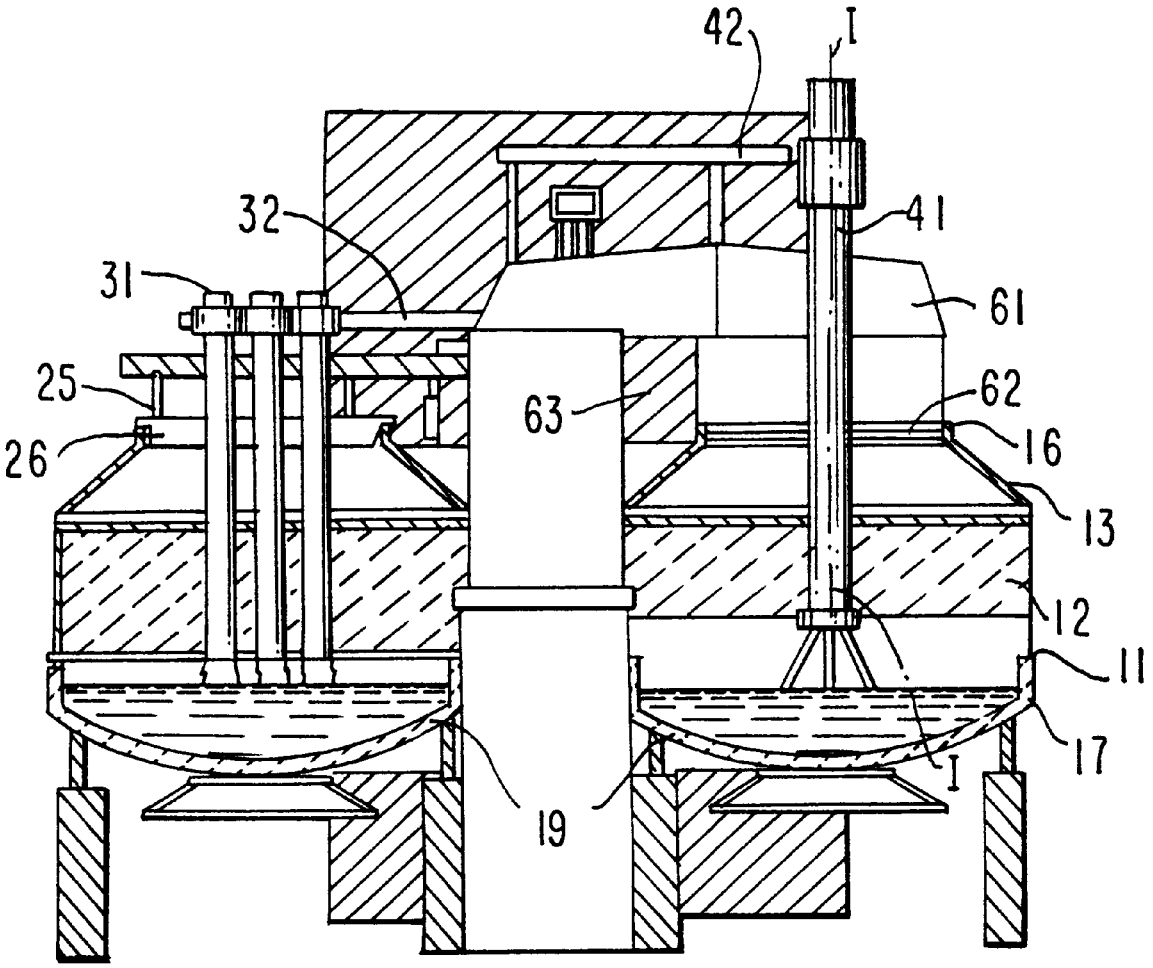
FIG. 2 is side view of the metallurgical vessel.

FIG. 2 shows both operating modes in schematic fashion. The metallurgical vessel 11 functions first as a converter, then as an electric arc furnace. Secured to the lance bracket 42 is the lance 41, which runs coaxially relative to the main vessel axis I and passes through the waste gas elbow 61 and the cover center 15 and cover center opening 16 into the interior of the upper vessel part 12. The upper part 12 and the lower part 17 together form the furnace vessel 11, which is closed by the cover 13. The cover 13 has the cover center opening 16, against which the opening 62 of the waste gas elbow 61 rests. The waste gas elbow 61 can be turned via the turning device 63.

The lower vessel 17 has a tap hole 19 (here, the bottom tap) for the metal melt.

The furnace on the left side of the drawing has an electrode bracket 32, to which are secured, in the present case, three electrodes 31. The three electrodes 31 are run through the cover center 25, which closes the cover center opening 26.

We claim:

1. A process for metallurgically treating iron metals in a vessel, comprising the steps of:

deoxidizing an iron containing metal pool on a bottom of the vessel by adding Al/Si;

charging low carbon iron charge materials into the metal pool in the vessel;

supplying oxygen to the vessel to provide non-electric heat energy to the metal pool and the charge materials;

implementing refining of the charge materials while simultaneously charging pig iron and adding lime into the metal pool;

removing up to 50% of slag that contains $Si/O_2$ and is formed by the refining of the charge materials;

suctioning off waste gases produced by the refining;

removing the slag, that contains phosphorous, at an end of refining;

furnishing heat energy via an electric arc to the metal pool and the charge materials;

suctioning off flue gases created by heating the charge materials and metal pool with the electric arc;

removing residual slag formed by the heating of the charge materials and metal pool with the electronic arc; and, tapping ferrous liquid melt from the metal pool and the heated charge materials while maintaining a portion of the pool in the vessel to permit restarting of the process, the steps being carried out so that the vessel first acts as a converter and then as a direct arc furnace.

2. A process as defined in claim 1, wherein the step of charging low carbon iron charge materials includes charging scrap containing low carbon material.

3. A process as defined in claim 1, including carrying out the refining by top blowing of oxygen.

4. A process as defined in claim 1, wherein the refining includes burning one of an oxygen-natural gas mixture and an oxygen-oil mixture with an over extended flame in a hyperstoichiometeric manner.

5. A process as defined in claim 1, including charging liquid pig iron and liquid iron charge material into the metal pool at a ratio of liquid pig iron; liquid iron charge material of approximately 50:50.

6. A process as defined in claim 2, including charging pig iron and scrap charge material into the metal pool at a ratio of scrap:pig iron in a range of 20:80 to 40:60.

7. A process as defined in claim 2, including charging scrap charge material, liquid iron charge material and pig iron at a ratio of scrap:pig iron:liquid iron charge material in a range of 10:60:30 to 10:40:50.

8. A process as defined in claim 1, wherein the step of charging low carbon iron charge materials includes charging the low carbon charge materials in liquid form.

9. A process as defined in claim 8, including charging the liquid low carbon charge materials at a temperature of over 1300° C.

10. A steel making device, comprising:

at least one metallurgical vessel having an upper part, a lower part, a bottom, and an open top;

a cover swingably arranged to close the top of the metallurgical vessel, the cover having a removable cover center with an opening;

a flue gas elbow connected to the cover;

a flush-off opening and a melt tap opening being arranged in the bottom of the vessel;

a waste gas elbow having an opening configured to be placeable on the cover center opening;

at least one lance configured to be insertable into an interior of the upper part of the metallurgical vessel through the cover center opening via the waste gas elbow; and means for furnishing heat energy to the vessel via an electric arc.

11. A steel making device as defined in claim 10, and further comprising a gas purification unit connected to the flue gas elbow.

12. A steel making device as defined in claim 10, and further comprising means for filling the vessel with charge material.

13. A steel making device as defined in claim 10, wherein the lance is configured and arranged to run coaxial with a main axis of the metallurgical vessel, and so that a depth of submersion of the lance into the vessel is adjustable.

14. A steel making device as defined in claim 13, and further comprising an oxygen supply station connected to the lance.

15. A steel making device as defined in claim 14, and further comprising fuel supply means connected to the lance.

16. A steel making device as defined in claim 15, wherein the fuel supply means is configured to supply one of natural gas and oil to the lance.

17. A steel making device as defined in claim 15, wherein the lance is configured as a burner.

18. A steel making device as defined in claim 10, and further comprising a main flue gas line and an after burning chamber connected between the main flue gas line and the waste gas elbow.

19. A steel making device as defined in claim 10, wherein the lower part of the metallurgical vessel is configured to downwardly curve for receiving liquid charges.

20. A steel making device as defined in claim 10, wherein two metallurgical vessels are provided, and further comprising a single electric power supply and a single oxygen or fuel station connected to the vessels for powering the electric arc.

21. A steel making device as defined in claim 20, wherein the waste gas elbow is arranged along a line that separates the two vessels, and further comprising turning means for permitting alternative placement of the opening of the waste gas elbow onto one of the cover center openings of the vessel covers.

* * * * *